US011424583B2

(12) United States Patent
Shao

(10) Patent No.: US 11,424,583 B2
(45) Date of Patent: Aug. 23, 2022

(54) SERIALLY-CONNECTABLE LIGHT STRING

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 63 days.

(21) Appl. No.: 16/573,880

(22) Filed: Sep. 17, 2019

(65) Prior Publication Data

US 2020/0400278 A1 Dec. 24, 2020

(30) Foreign Application Priority Data

Jun. 19, 2019 (CN) ..... 201910533343.7
Aug. 21, 2019 (CN) ..... 201910773566.0

(51) Int. Cl.
*H01R 31/06* (2006.01)
*F21S 4/26* (2016.01)
(Continued)

(52) U.S. Cl.
CPC ..... *H01R 31/06* (2013.01); *F21S 4/26* (2016.01); *F21V 15/01* (2013.01); *F21V 21/005* (2013.01); *F21V 23/001* (2013.01); *F21V 23/005* (2013.01); *H01R 4/2406* (2018.01); *H01R 12/75* (2013.01); *H01R 13/05* (2013.01);
(Continued)

(58) Field of Classification Search
CPC ..... H01R 31/06; H01R 4/2406; F21S 4/26; H05B 45/48
See application file for complete search history.

(56) References Cited

U.S. PATENT DOCUMENTS 4,379,609 A 4/1983 Hardesty
4,438,998 A 3/1984 Myers
(Continued)

FOREIGN PATENT DOCUMENTS

CA 2 655 486 A1 9/2009
CN 200982547 Y 11/2007
(Continued)

OTHER PUBLICATIONS

U.S. Appl. No. 16/846,784, filed Apr. 13, 2020, Inventor Shu-Fa Shao (49 pages).
(Continued)

*Primary Examiner* — Abdullah A Riyami
*Assistant Examiner* — Thang H Nguyen
(74) *Attorney, Agent, or Firm* — Christensen, Fonder, Dardi & Herbebrt PLLC; John Fonder

(57) ABSTRACT

A serially-connectable light string includes a first power wire, a second power wire, a first electrical connector, a second electrical connector and a plurality of light emitting diodes. The first power wire and the second power wire are arranged in parallel. The first electrical connector is connected to one end of first power wire and one end of the second power wire. The second electrical connector is connected to the other end of first power wire and the other end of the second power wire. The first electrical connector and the second electrical connector respectively include a plurality terminal portions corresponding to the first power wire and the second power wire.

20 Claims, 15 Drawing Sheets

(51) Int. Cl.

| | |
|---|---|
| ***H01R 4/2406*** | (2018.01) |
| ***H05B 45/48*** | (2020.01) |
| ***H01R 24/28*** | (2011.01) |
| ***H01R 12/75*** | (2011.01) |
| ***H01R 13/627*** | (2006.01) |
| ***F21V 15/01*** | (2006.01) |
| ***F21V 21/005*** | (2006.01) |
| ***F21V 23/00*** | (2015.01) |
| ***H01R 13/05*** | (2006.01) |
| *H01R 105/00* | (2006.01) |
| *F21Y 103/10* | (2016.01) |
| *F21Y 115/10* | (2016.01) |

(52) U.S. Cl.

CPC ..... *H01R 13/6273* (2013.01); *H01R 13/6278* (2013.01); *H01R 24/28* (2013.01); *H01R 31/065* (2013.01); *H05B 45/48* (2020.01); *F21Y 2103/10* (2016.08); *F21Y 2115/10* (2016.08); *H01R 2105/00* (2013.01)

(56) References Cited

U.S. PATENT DOCUMENTS 4,460,234 A 7/1984 Bogese
4,593,966 A 6/1986 Meyer
4,761,720 A 8/1988 Solow
4,812,956 A 3/1989 Chen
4,895,532 A 1/1990 Bogese, II
4,908,743 A 3/1990 Miller
5,106,306 A 4/1992 Ditzig
5,109,324 A 4/1992 Ahroni
5,150,964 A 9/1992 Tsui
5,245,519 A 9/1993 Openiano
5,454,737 A 10/1995 Saba
5,645,342 A 7/1997 Chang
5,697,815 A 12/1997 Drewnicki
5,747,940 A 5/1998 Openiano
5,834,901 A 11/1998 Shen
5,943,751 A * 8/1999 Kamei ..... H01R 43/052 29/33 M
5,975,717 A 11/1999 Rahman
6,042,418 A 3/2000 Cummings
6,066,807 A * 5/2000 Gudgeon ..... H02G 3/083 174/136
6,086,221 A 7/2000 Wu
6,086,222 A 7/2000 Juba
6,091,204 A 7/2000 Chen
6,113,432 A 9/2000 Liao
6,146,207 A 11/2000 Mulot
6,518,707 B2 * 2/2003 Gershen ..... H05B 39/105 315/129
6,582,094 B2 6/2003 Liu
6,609,814 B2 8/2003 Ahroni
6,777,891 B2 8/2004 Lys et al.
6,914,194 B2 7/2005 Fan
7,048,550 B2 5/2006 Hyland et al.
7,062,442 B2 6/2006 Sugar
7,088,904 B2 8/2006 Ryan, Jr.
7,160,140 B1 1/2007 Mrakovich et al.
7,235,815 B2 6/2007 Wang
7,250,730 B1 7/2007 Allen
7,253,566 B2 8/2007 Lys et al.
7,338,327 B2 3/2008 Sticker et al.
7,481,555 B2 1/2009 Huang et al.
7,494,244 B1 2/2009 Van Diep
7,554,266 B1 6/2009 Chen
7,569,996 B2 8/2009 Holmes
7,784,961 B1 8/2010 Rawlings
7,905,753 B2 3/2011 Siev et al.
7,926,978 B2 4/2011 Tsai
7,976,191 B2 7/2011 Gibboney
8,070,347 B1 * 12/2011 Lin ..... F21S 4/10 362/656
8,203,275 B2 6/2012 Ruxton
8,397,381 B2 3/2013 Tsai
8,454,186 B2 6/2013 Chen
8,454,187 B2 6/2013 Chen
8,469,734 B2 6/2013 Chen
8,469,750 B2 6/2013 Chen
8,480,278 B2 7/2013 Wasem
8,562,175 B2 10/2013 Chen
8,568,015 B2 10/2013 Chen
8,569,960 B2 10/2013 Chen
8,592,845 B2 11/2013 Chen
8,598,805 B2 12/2013 Tremblay
8,608,342 B2 12/2013 Chen
8,622,576 B2 1/2014 Zhan
8,641,229 B2 2/2014 Li
8,672,510 B1 * 3/2014 Budelman ..... H05B 39/105 362/249.14
8,680,773 B2 3/2014 Hering et al.
8,876,321 B2 11/2014 Chen
8,974,072 B2 3/2015 Chen
9,044,056 B2 6/2015 Chen
9,055,777 B2 6/2015 Chen
9,066,617 B2 6/2015 Chen
9,157,587 B2 10/2015 Chen
9,166,323 B2 10/2015 Lampert et al.
9,179,793 B2 * 11/2015 Chen ..... A47G 33/08
9,220,361 B1 12/2015 Chen
9,222,656 B2 12/2015 Chen
9,279,551 B2 3/2016 Vissenberg et al.
9,291,318 B1 3/2016 Benson
9,318,840 B2 4/2016 Siev et al.
9,386,652 B1 7/2016 Lee
9,439,528 B2 9/2016 Chen
9,441,800 B1 9/2016 Chen
9,441,823 B1 9/2016 Chen
9,468,062 B2 10/2016 Rybicki
9,526,286 B2 12/2016 Chen
9,572,446 B2 2/2017 Chen
9,593,831 B2 3/2017 Chen
9,763,298 B2 3/2017 Yu
9,648,919 B2 5/2017 Chen
9,655,211 B2 * 5/2017 Altamura ..... H05B 47/19
9,671,074 B2 6/2017 Chen
9,677,748 B1 6/2017 Chen
9,677,749 B2 6/2017 Chen
9,788,384 B1 10/2017 Harris
9,845,925 B2 12/2017 Chen
9,883,566 B1 1/2018 Chen
9,899,765 B2 2/2018 Wagner
10,006,596 B2 6/2018 Yu et al.
10,103,493 B2 10/2018 Siev et al.
10,136,497 B2 11/2018 Harris
10,178,887 B1 * 1/2019 Chen ..... A41G 1/005
10,184,654 B1 1/2019 Chen
10,205,073 B2 2/2019 Altamura
10,288,235 B1 5/2019 Chen
10,288,236 B1 5/2019 Chen
10,578,260 B1 * 3/2020 Chen ..... F21V 21/002
10,578,289 B2 * 3/2020 Chen ..... H01B 7/04
10,624,166 B1 4/2020 Shao
10,697,598 B1 6/2020 Chen et al.
10,950,988 B1 * 3/2021 Thiel ..... H01R 13/6675
11,060,674 B1 * 7/2021 Liu ..... F21V 23/06
2002/0027778 A1 3/2002 Ko
2003/0063463 A1 4/2003 Sloan et al.
2004/0012950 A1 1/2004 Pan
2004/0080281 A1 4/2004 Pan
2004/0090770 A1 5/2004 Primeau
2004/0096596 A1 5/2004 Palmer, III et al.
2004/0165384 A1 8/2004 Allen
2004/0246718 A1 12/2004 Fan
2005/0174065 A1 8/2005 Janning
2006/0158878 A1 7/2006 Howell
2006/0221609 A1 10/2006 Ryan, Jr.
2007/0015396 A1 1/2007 Mrakovich et al.
2007/0177402 A1 8/2007 Wu
2007/0230174 A1 10/2007 Hicks
2007/0262725 A1 11/2007 Koren

(56) References Cited

U.S. PATENT DOCUMENTS

2007/0279920 A1* 12/2007 Lin ..... F21S 4/10 362/362
2008/0049424 A1 2/2008 Wang
2008/0084695 A1 4/2008 Hsu
2008/0084702 A1 4/2008 Cheung
2008/0094828 A1 4/2008 Shao
2008/0218092 A1 9/2008 Chang et al.
2009/0154156 A1 6/2009 Lo et al.
2009/0278463 A1 11/2009 Tang
2009/0302771 A1 12/2009 Peng
2010/0001664 A1 1/2010 Shih
2010/0141161 A1 6/2010 Hering et al.
2010/0157598 A1 6/2010 Tsai
2010/0277084 A1 11/2010 Lee
2011/0062875 A1 3/2011 Altamura
2011/0074300 A1 3/2011 Hsu
2011/0104922 A1* 5/2011 Byrne ..... H01R 9/22 439/214
2011/0148311 A1 6/2011 Neuman
2011/0210677 A1 9/2011 Hering et al.
2011/0228535 A1 9/2011 Shao
2011/0305022 A1 12/2011 Chen
2011/0316442 A1 12/2011 Sako et al.
2012/0007510 A1 1/2012 Horng
2012/0039070 A1 2/2012 Shen et al.
2012/0040546 A1* 2/2012 Droesbeke ..... H01R 13/035 439/271
2012/0075863 A1 3/2012 Chen
2012/0275157 A1 11/2012 Hsu
2013/0078847 A1 3/2013 Chen
2013/0181232 A1 7/2013 Jeromerajan
2013/0249394 A1 9/2013 Fay
2013/0249417 A1 9/2013 Verlinden
2013/0301246 A1 11/2013 Chen
2014/0055439 A1 2/2014 Lee
2014/0057484 A1* 2/2014 Byrne ..... H02G 3/388 439/527
2014/0179132 A1* 6/2014 Byrne ..... H01R 25/162 439/92
2014/0268689 A1 9/2014 Chen
2014/0268818 A1 9/2014 Huang et al.
2014/0292214 A1* 10/2014 Huang ..... F21V 23/06 315/192
2014/0355277 A1 12/2014 Lin
2015/0008835 A1 1/2015 Sugiura et al.
2015/0029703 A1 1/2015 Chen
2015/0070878 A1 3/2015 Yu
2015/0117001 A1 4/2015 Fan
2016/0047516 A1 2/2016 Taylor
2016/0123566 A1 5/2016 Leung
2016/0149358 A1* 5/2016 Ariani ..... H01R 13/74 439/540.1
2016/0183338 A1 6/2016 Loomis
2016/0186940 A1 6/2016 Del Castillo et al.
2016/0286615 A1* 9/2016 Weeks, Jr ..... H05B 45/37
2016/0338171 A1 11/2016 Bhagat
2016/0341408 A1 11/2016 Altamura
2016/0356454 A1* 12/2016 Camarota ..... F21V 7/10
2017/0023223 A1 1/2017 Tsai
2017/0038055 A1 2/2017 Daniels
2017/0055319 A1 2/2017 Rogers
2017/0108185 A1 4/2017 He
2017/0295622 A1 10/2017 Harris
2017/0321850 A1* 11/2017 Chien ..... F21V 14/02
2017/0328527 A1 11/2017 Yang et al.
2017/0343170 A1 11/2017 Yu et al.
2018/0020519 A1 1/2018 Harris
2018/0020520 A1 1/2018 Harris
2018/0058648 A1 3/2018 Fang
2018/0073708 A1 3/2018 Avery et al.
2018/0110101 A1* 4/2018 Kottritsch ..... H05B 45/44
2018/0172225 A1 6/2018 Zhao
2018/0172226 A1* 6/2018 Zhao ..... G06F 3/04847
2018/0231226 A1* 8/2018 Koo ..... H05B 45/46
2018/0299084 A1 10/2018 Chien
2019/0053348 A1 2/2019 Harris
2019/0081436 A1 3/2019 Onodi et al.
2019/0234597 A1 8/2019 Zhu
2019/0277458 A1 9/2019 Shao
2019/0335559 A1 10/2019 Shao
2020/0236746 A1 7/2020 Shao
2021/0255223 A1* 8/2021 Barezzani ..... H01R 4/2406
2021/0265786 A1* 8/2021 Mishra ..... H01R 13/6675
2021/0301987 A1* 9/2021 Xiong ..... F21K 9/278

FOREIGN PATENT DOCUMENTS

CN 201121811 Y 9/2008
CN 201897194 U 7/2011
CN 201898147 U 7/2011
CN 201966240 U 9/2011
CN 202613183 U 12/2012
CN 203703878 U 7/2014
DE 3240446 A1 7/1983
EP 1 172 602 A1 1/2002
GB 2 454 546 A 5/2009

OTHER PUBLICATIONS

U.S. Appl. No. 16/573,890, filed Sep. 17, 2019, Inventor Shu Fa Shao (44 pages).
U.S. Appl. No. 16/298,935, filed Mar. 11, 2019, Inventor Shu Fa Shao (81 pages).
U.S. Appl. No. 16/219,657, filed Dec. 13, 2018, Inventor Johnny Chen (155 pages).

* cited by examiner

SERIALLY-CONNECTABLE LIGHT STRING

RELATED APPLICATIONS

The present application claims priority to Chinese Patent Application No. 201910533343.7, filed on Jun. 19, 2019 and Chinese Patent Application No. 201910773566.0, filed Aug. 21, 2019, which said applications are incorporated by reference in their entirety herein.

FIELD OF THE INVENTION

This disclosure relates to a light string, and more particularly to a serially-connectable light string.

BACKGROUND OF THE INVENTION

A light string includes plural light sources directly soldered onto the power wire at intervals, so as to form a string-shaped illumination device without a lamp holder in the art. To small-sized light sources, such as small bulbs, light-emitting diodes, light strings are a common arrangement of the light sources. A light string is as flexible as the power wire is, such that the light string is easily arranged in any configuration to comply with requirements for special illumination or decoration.

The length of a light string is generally fixed or predetermined. If it is required to elongate the length of the light string, multiple light strings have to be soldered together according to the circuit design of the light string. The soldering process is difficult to perform on a light string with thin power wires, and soldering defects usually result.

SUMMARY

An embodiment of this disclosure provides a serially-connectable light string to solve the above-mentioned problem.

The present disclosure discloses a serially-connectable light string, including a first power wire, a second power wire, a first electrical connector, a second electrical connector and plurality of light emitting diodes. The first power wire and the second power wire are arranged in parallel. The first electrical connector is connected to one end of a first power wire and one end of a second power wire. The second electrical connector is connected to the other end of first power wire and the other end of the second power wire. The first electrical connector and the second electrical connector respectively include a plurality of terminal pins corresponding to the first power wire and the second power wire. The plurality of light emitting diodes are connected to the first power wire.

In one or more embodiments, the serially-connectable light string further includes a terminal-shorting pin, inserted into the second electrical connector for short-circuiting the first power wire and the second power wire in the second electrical connector.

In one or more embodiments, the first electrical connector and the second electrical connector are a cable plug and a cable socket, or the electrical connector and the second electrical connector are a headphone-style plug and a headphone-style socket.

In one or more embodiments, the serially connectable light string further includes a fixing case, for covering the first electrical connector and the second electrical connector.

In one or more embodiments, the first electrical connector and the second electrical connector respectively include a plurality of through holes, and the first power wire and the second power wire pass through the through holes and are reverse folded to form the plurality of terminal pins; and the fixing case further includes a circuit board, and the circuit board includes printed wires (conductors) for contacting the plurality of terminal pins of the first electrical connector and the second electrical connector.

In one or more embodiments, the plurality of light emitting diodes are connected into a series circuit, and the two ends of the series circuit are respectively connected to the first power wire and the second power wire, respectively.

In one or more embodiments, the light emitting diodes are connected in parallel between the first power wire and the second power wire.

In one or more embodiments, the plurality of light emitting diodes are arranged into a plurality of parallel circuits and the parallel circuits are connected in series.

In one or more embodiments, the serially-connectable light string further includes a plurality of transparent lamp caps; wherein each of the lamp caps includes a body, two guiding portions and a guiding groove, a bottom of the body is equipped with an accommodating dent or recess, and a flange extending outward, the two guiding portions extend outward from an edge of the flange, and the guiding groove extends from the bottom of the body to the guiding portion via the flange.

According to embodiments of this disclosure, plural serially-connectable light strings can be easily connected in series, so as to elongate the length of a light string as required, and in some embodiments, a soldering process is not required.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
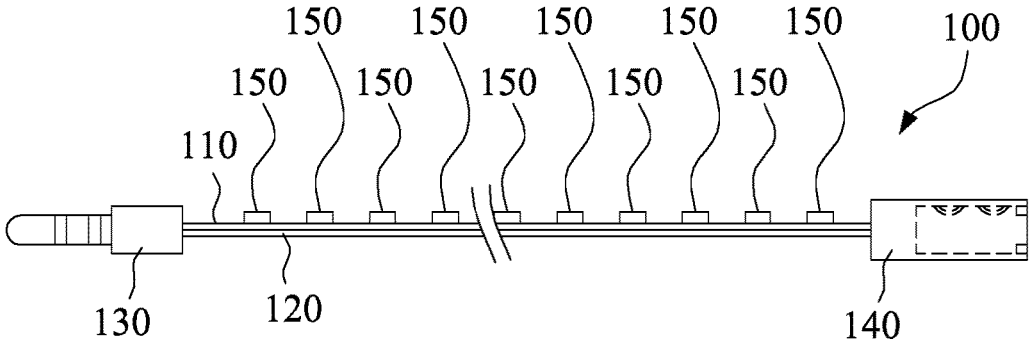
FIG. 1 is a schematic view of a serially-connectable light string according to a first embodiment of this disclosure.
Figure 2:
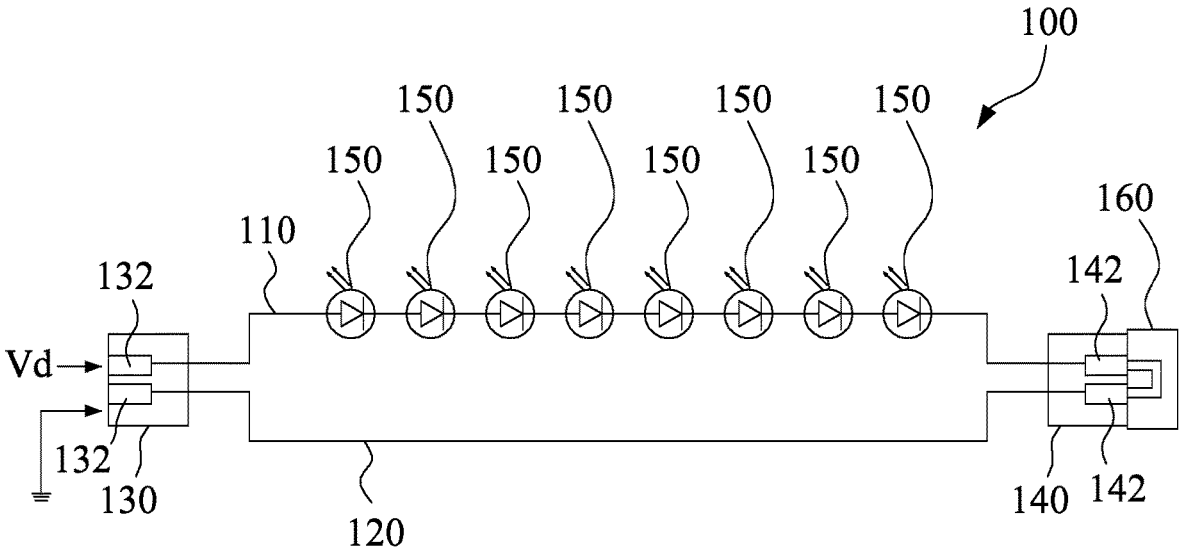
FIG. 2 is a circuit diagram of the serially-connectable light string according to the first embodiment of this disclosure.

Referring to FIG. 1 and FIG. 2, a serially-connectable light string 100 according to a first embodiment includes a first power wire 110, a second power wire 120, a first electrical connector 130, a second electrical connector 140, and a plurality of light emitting diodes 150 (LEDs 150). As described further below, electrically conductive wires 110 and 120 may be covered by an insulation portion.

It will be understood, and as also described further below, the phrase "serially-connectable light string" means that the light string may be connected to another light string in an end-to-end fashion, to form a series of connected light strings. However, "serially connectable" is not intended to be limited to an electrical series connection between light strings, but rather, the electrical connection between light strings may be any electrical connection, including a series electrical connection or a parallel electrical connection. In an embodiment, such a connection between light strings may be made during a manufacturing process, or made by a user after the manufacture and sale of individual light strings.

As shown in FIG. 1 and FIG. 2, the first power wire 110 and the second power wire 120 are arranged in parallel. The first electrical connector 130 is connected to one end (a first end) of first power wire 110 and one end (a first end) of the second power wire 120, and the second electrical connector 140 is connected to the other end (second end) of first power wire 110 and the other end (second end) of the second power wire 120. The first electrical connector 130 and the second electrical connector 140 respectively include a plurality of terminal pins 132, 142 corresponding to the first power wire 110 and the second power wire 120. The first electrical connector 130 and the second electrical connector 140 are paired, for example, as a plug and a socket, respectively. Therefore, the first electrical connector 130 is configured to be insertable into a second electrical connector 140 of another serially-connectable light string 100. In such an embodiment, terminals 132 of a second light string 100 are in electrical connection with terminals 142 of the first light string 100.

In the embodiment depicted in FIG. 2, a shorting pin or shorting plug 160 is inserted into second electrical connector 140 such that the second ends of wires 110 and 120 are electrically connected together, or "shorted". Such a configuration completes a series connection of the electrical circuit of the depicted first light string 100, such that the plurality of LEDs 150 are connected to one another in electrical series.

Figure 3:
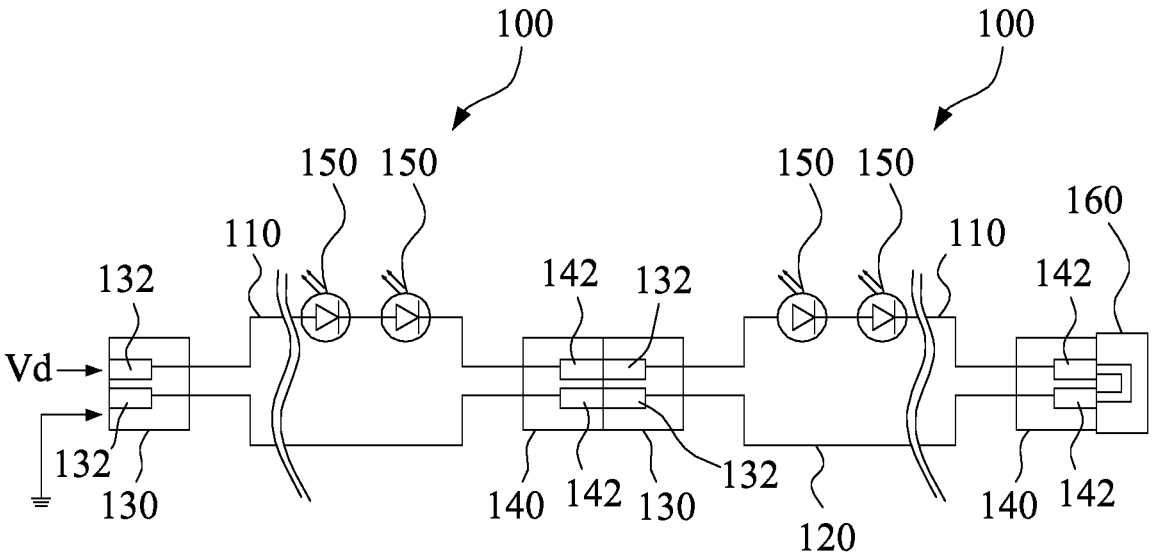
FIG. 3 is another circuit diagram of the serially-connectable light string according to the first embodiment of this disclosure.

In an embodiment, shorting pin or plug 160 may take the form of a pin or other electrical shunt or connecting device that is integral to second connector 140 and not readily removable by a user. In other embodiments, shorting pin or plug 160 may form a shorting plug 160 that is insertable into second connector 140 and that electrically connects terminals 142 and wires 110 and 120. In one such embodiment, shorting plug 160 may be removable by a user so as to connect a second light string 100 to the first light string 100, as described further below and as depicted in FIG. 3, so as to connect the two serially-connectable light strings 100 into a single long serial circuit. The unused first electrical connector 130 can be connected to a power source, so as to provide a driving voltage Vd to the first power wire 110 and electrically ground the second power wire 120.

As shown in FIG. 2, the plurality of LEDs 150 are connected to the first power wire 110. In the first embodiment, the plurality of LEDs 150 are arranged on the first power wire 110 and serially connected. In the first embodiment, the serially-connectable light string 100 further includes the terminal-shorting pin 160, inserted to the second electrical connector 140 for short-circuiting the first power wire 110 and the second power wire 120, at their second ends, in the second electrical connector 140. When applying the driving voltage Vd to the first power wire 110 and the second power wire 120 via the first electrical connector 130, the first power wire 110, the second power wire 120 and the terminal shorting pin 160 form a circuit loop to drive the plurality of LEDs 150 to emit light.

As shown in FIG. 3, when a longer light string is required, a second serially-connectable light string 100 (right-side light string as depicted) is connected to the first serially-connectable light string 100 (left-side light string as depicted). In this configuration, the terminal shorting pin or plug 160 is not inserted into the second connector 140 of the first light string 100, as depicted in FIG. 2, but rather, the terminal shorting pin 160 is inserted into the second electrical connector 140 of this second serially connectable light string 100. The first electrical connector 130 of the second serially connectable light string 100 is connected to the second electrical connector 140 of the first serially-connectable light string 100, so as to elongate the length of the light string. This causes the plurality of LEDs 150 of the first light string 100 to be electrically connected in series to the plurality of LEDs 150 of the second light string 100. Known light strings typically connect in an end-to-end fashion in parallel, in part because the voltage output of a connected voltage source is fixed. However, in the light string system of the present invention, light strings 100 may be connected plugged into one another so as to form series circuits, including a single series circuit as depicted, that includes light elements, such as LEDs 150 from both light strings. As long as the driving voltage Vd and the output current are able to drive the plurality of LEDs 150 of the multiple light strings, typically meaning providing a higher voltage and current, plural serially-connectable light strings 100 can be serially-connected to satisfy any required length.

Figure 4:
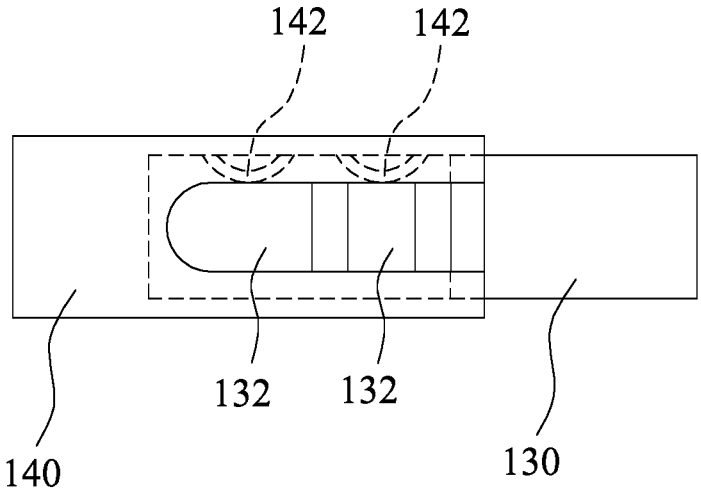
FIG. 4 is a schematic view of a first electrical connector and a second electrical connector according to the first embodiment of this disclosure.
Figure 5:
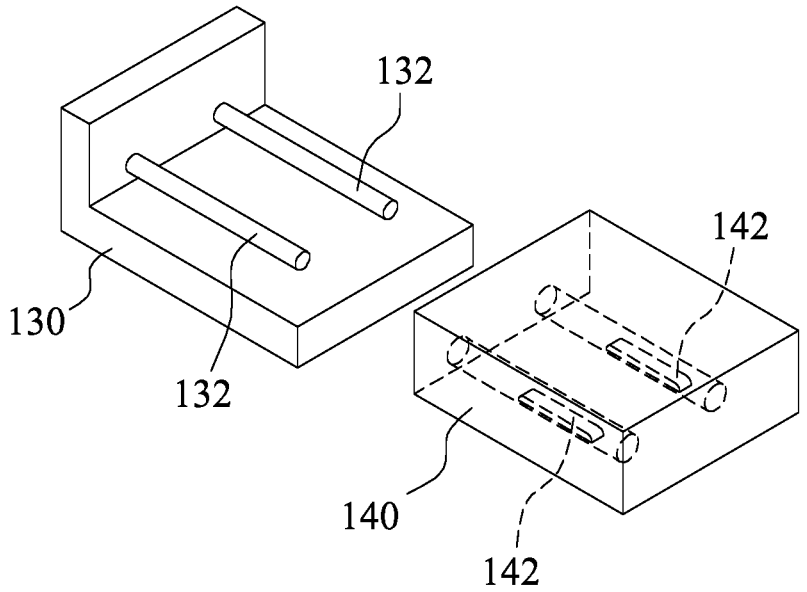
FIG. 5 is a perspective view of another first electrical connector and another second electrical connector according to the first embodiment of this disclosure.
Figure 6:
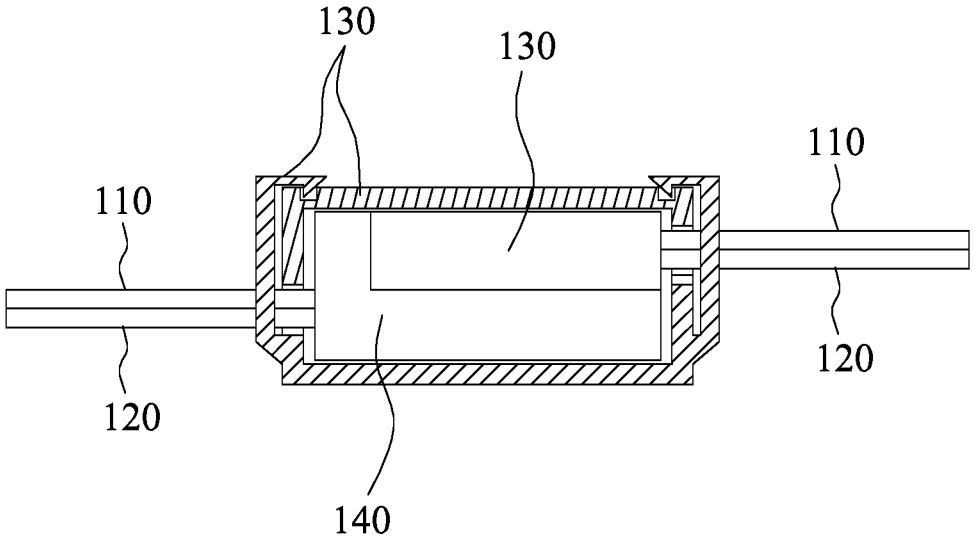
FIG. 6 is a cross-sectional view of a fixing case covering the first electrical connector and the second electrical connector according to the first embodiment of this disclosure.

As shown in FIG. 4, FIG. 5 and FIG. 6, the first electrical connector 130 and the second electrical connector 140 can be any type of connector, as long as the connector includes at least two sets of terminal pins 132, 142 to respectively connect to the first power wire 110 and the second power wire 120, including their respective conductors. In an embodiment, terminals 132 may comprise male terminals and terminals 142 may comprise female terminals; in another embodiment, terminals 132 may comprise female terminals and terminals 142 may comprise male terminals. Other types of connecting terminals may be used that are not strictly male-female terminals. As shown in FIG. 4, in an embodiment, the first electrical connector 130 and the second electrical connector 140 can be a cable plug and a cable socket. As shown in FIG. 5, the first electrical connector 130 and the second electrical connector 140 can be a headphone-style plug and a headphone-style socket.

As shown in FIG. 6, for the purpose of water-proofing or preventing exposure of terminals so as to avoid electric shock, the second serially connectable light string 100 further includes a fixing case, latching case, cover, or housing 170, also referred to herein as a joining cover or case, for joining and covering the first electrical connector 130 and the second electrical connector 140 after the two connectors are connected, and for maintaining the connection between the connectors 130 and 140. The joining case 170 prevents the first electrical connector 130 and the second electrical connector 140 from being separated, and also prevents the first electrical connector 130 and the second electrical connector 140 from getting wet when the light string is exposed to water or to wet conditions, which otherwise could lead to a short-circuit. The joining case 170 can be composed of a plurality of members latching to each other, which, in an embodiment, can be easily to assembled and disassembled. In an alternative embodiment, the joining case 170 can be a heat shrink tube, directly and tightly wrapping the first electrical connector 130 and the second electrical connector 140 after the two connectors are connected.

Referring to FIG. 7 to FIG. 11, in an embodiment, the first electrical connector 130 and the second electrical connector 140 are both electrical plugs, and the joining case 170 is an electrical socket.

Figure 7:
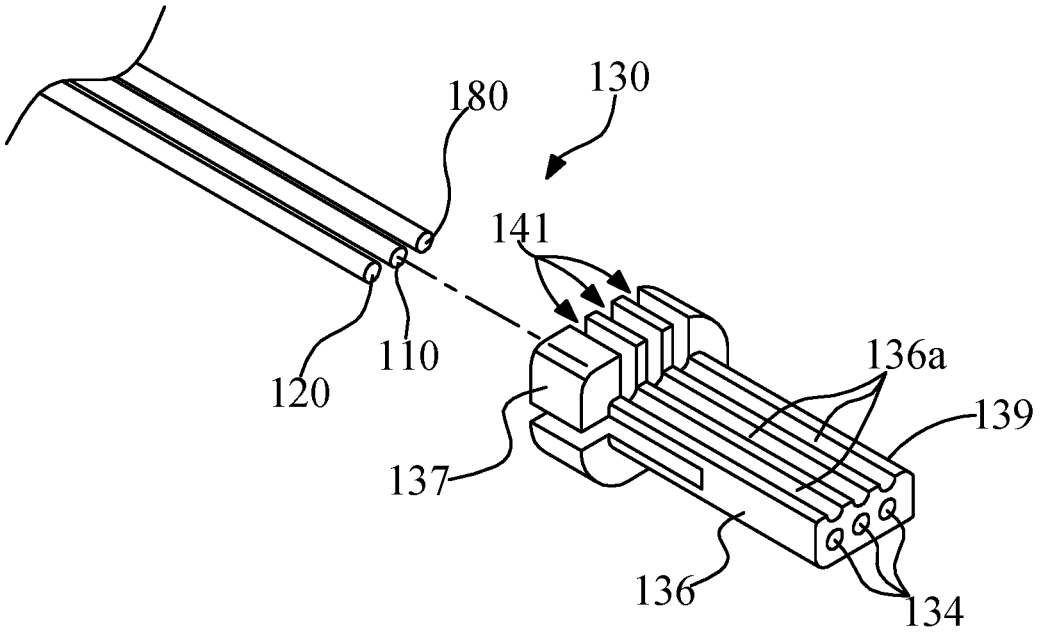
FIG. 7 is an exploded view of yet another first electrical connector according to the first embodiment of this disclosure.
Figure 8:
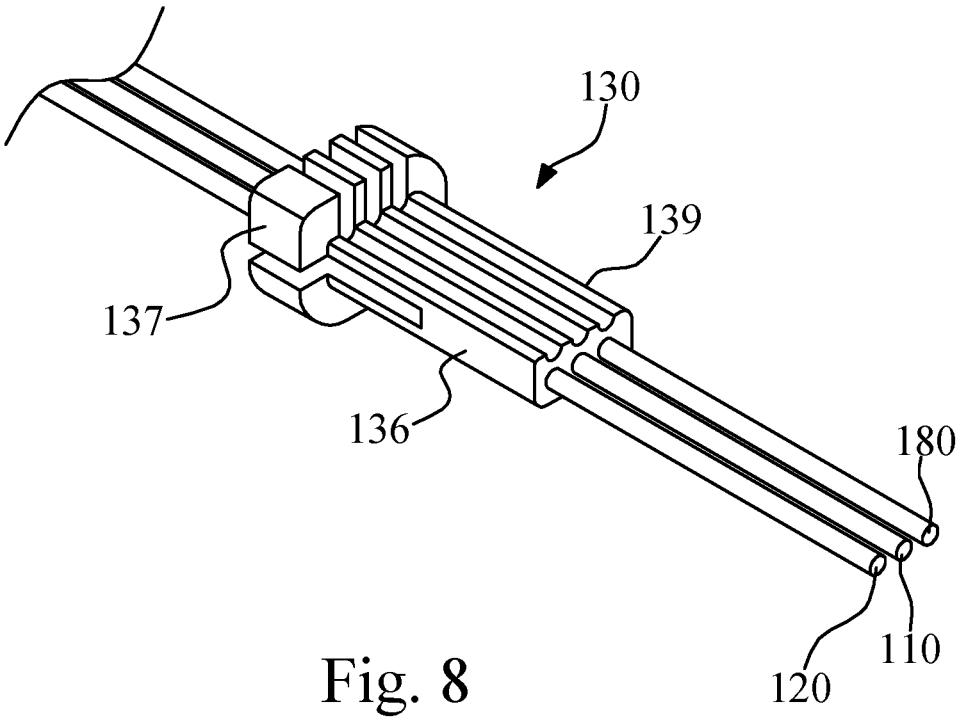
FIG. 8 and FIG. 9 are perspective views of the yet another first electrical connector according to the first embodiment of this disclosure.
Figure 9:
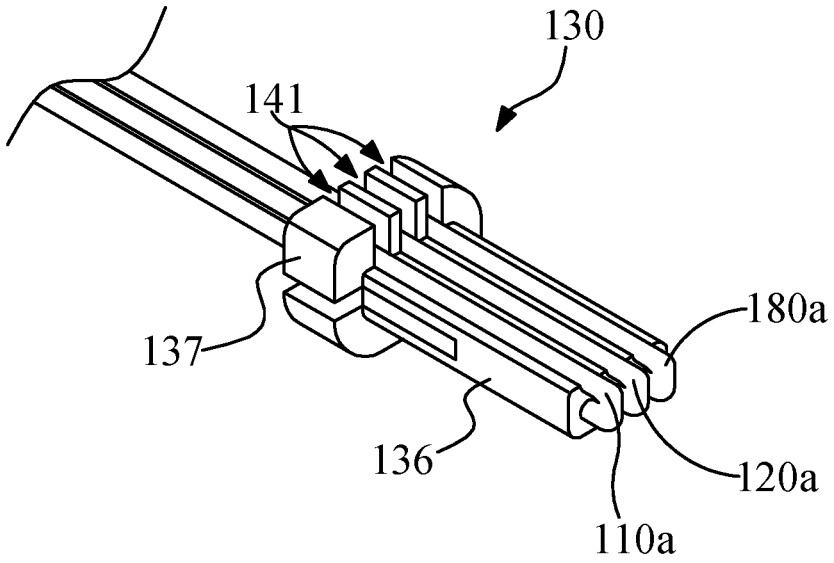

As shown in FIG. 7, FIG. 8, and FIG. 9, in an embodiment, each light string includes three wires, first power wire 110, second power wire 120 and third power wire 180, rather than just two wires as depicted and described in the previous embodiment. In this embodiment, the first electrical connector 130 includes a first or insertable body portion 136 and a second or wire-portion 137. In an embodiment, first portion 136 defines a plurality of through holes 134, and the first power wire 110, the second power wire 120 and the third power wire 180 are configured to receive the power wires such that the wires 110, 120, and 180 extend through the through holes 134. In an embodiment, first portion 136 also defines grooves 136*a* on a first surface 139, which may be a top surface.

In an embodiment, second portion 137 may define a plurality of wire-receiving slots 141 that are configured to respectively receive portions of power wires 110, 120 and 180. In an embodiment, the received portions of power wires 110, 120 and 180 comprise end or terminal portions of the wires.

The first power wire 110, the second power wire 120 and the third power wire 180 are initially inserted through the through holes 134 of portion 136 of first electrical connector 130. The power wires 110, 120, 180 are then reverse folded, or folded back onto the surface 139 of an insertable portion 136 of the first electrical connector 130 and into grooves 136*a*.

In an embodiment, the portions of wires 110, 120 and 180 extending out from through holes 134 and back onto surface 137 comprise uninsulated conductors, including wire portions 110*a*, 120*a*, and 180*a*. Wire portions 110*a*, 120*a* and 180*a* comprise all or portions of those uninsulated conductor portions of wires 110, 120 and 180, respectively, that extend out of through holes 134 and bend back or curve away from, then follow, the longitudinal axis defined by each respective wire. A portion of each or wire portion 110*a*, 120*a* and 180*a*, extends outwardly and away from first portion 136 along the respective longitudinal axes of wires 110, 120 and 180, then bends or curves transversely, or as depicted, perpendicularly, to the longitudinal wire axes, then extends in parallel to the longitudinal axes. As such, terminal portions of wires 110, 120 and 180 are radially displaced from other portions of wires 110, 120 and 180, respectively, and extending in parallel to the main longitudinal axes of the wires. These wire portions 110*a*, 120*a* and 180*a*, and in particular are used as, or form, the electrical contact points of the end of the light string. In other words, these wire portions 110*a*, 120*a*, and 180*a* form the plurality of "terminals" 132 in this embodiment. Therefore, in this case, the process for soldering the power wires 110, 120, 180 to terminal pins 132 is not required, as portions of the power wires form the terminals 132. In an embodiment, wire portions 110*a*, 120*a* and 180*a* comprise terminal portions of wires 110, 120 and 180 that are configured to electrically contact terminal portions of corresponding power wires of another light set 100 via intermediate conducting structures or paths, as described further below.

The plurality of grooves 136*a* disposed on the surface 139 of the insert portion 136 receive portions 110*a*, 120*a* and 180*a* of the first power wire 110, the second power wire 120 and the third power wire 180, respectively, and position the wires such that they are not in electrical or mechanical contact with one another.

In an embodiment, slots 141 of second portion 137 receive portions of wires 110/110*a*, 120/120*a* and 180/180*a*, so as to further secure the wires to connector 130 and to insulate wires 110, 120 and 180 from one another, thereby preventing accidental shorting or connecting of the respective wires.

In an embodiment, the second electrical connector 140 is substantially identical to the first electrical connector 130; the detail of the second electrical connector 140 is omitted hereinafter.

In other embodiments, it will be understood that light strings 100, rather than including three power wires, may include fewer, such as two power wires, or more power wires, such as four or more power wires.

Figure 10:
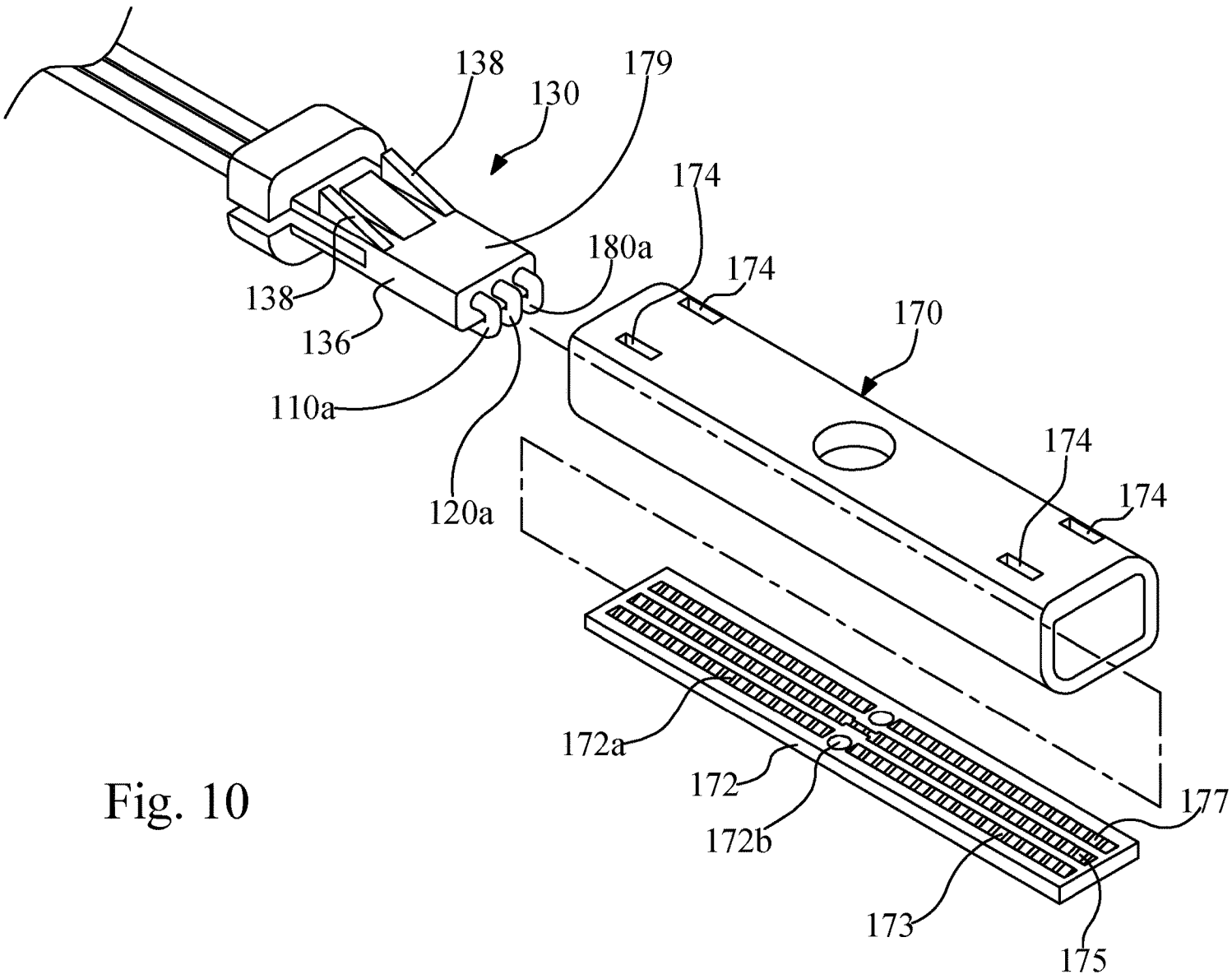
FIG. 10 is an exploded view of another fixing case according to the first embodiment of this disclosure.

As shown in FIG. 10, in an embodiment, the joining case 170 further includes a circuit board 172, and the circuit board 172 includes printed conductors 172*a*. In an embodiment, the printed conductors extend from one end to the other end of the circuit board 172, for contacting the plurality of terminals 132, 142, i.e., wire terminal portions 110*a*, 120*a*, and 180*a* of wires 110, 120 and 180, of the first electrical connector 130 to corresponding terminals or wire portions of the second electrical connector 140. In other embodiments, the conductors 172 may be interrupted and may not be electrically conductive in a continuous manner, as described further below.

As shown in FIG. 10, when connecting the first electrical connector 130 and the second electrical connector 140, the position of the first electrical connector 130 and the second electrical connector 140 relative to the joining case 170 is adjustable according to the arrangement of the circuit board 172, for having the power wires serving as the terminals 132, 142 facing the printed wires 172*a*. In the depicted embodiment, printed circuit board 172 is positioned between an inner wall of joining case 170 and connector 130 such that wire portions 110*a*, 120*a* and 180*a* are adjacent to a conductor-side of board 172, such that wire portions 110*a*, 120*a* and 180*a* are in electrical connection with conductors 172*a*.

Figure 11:
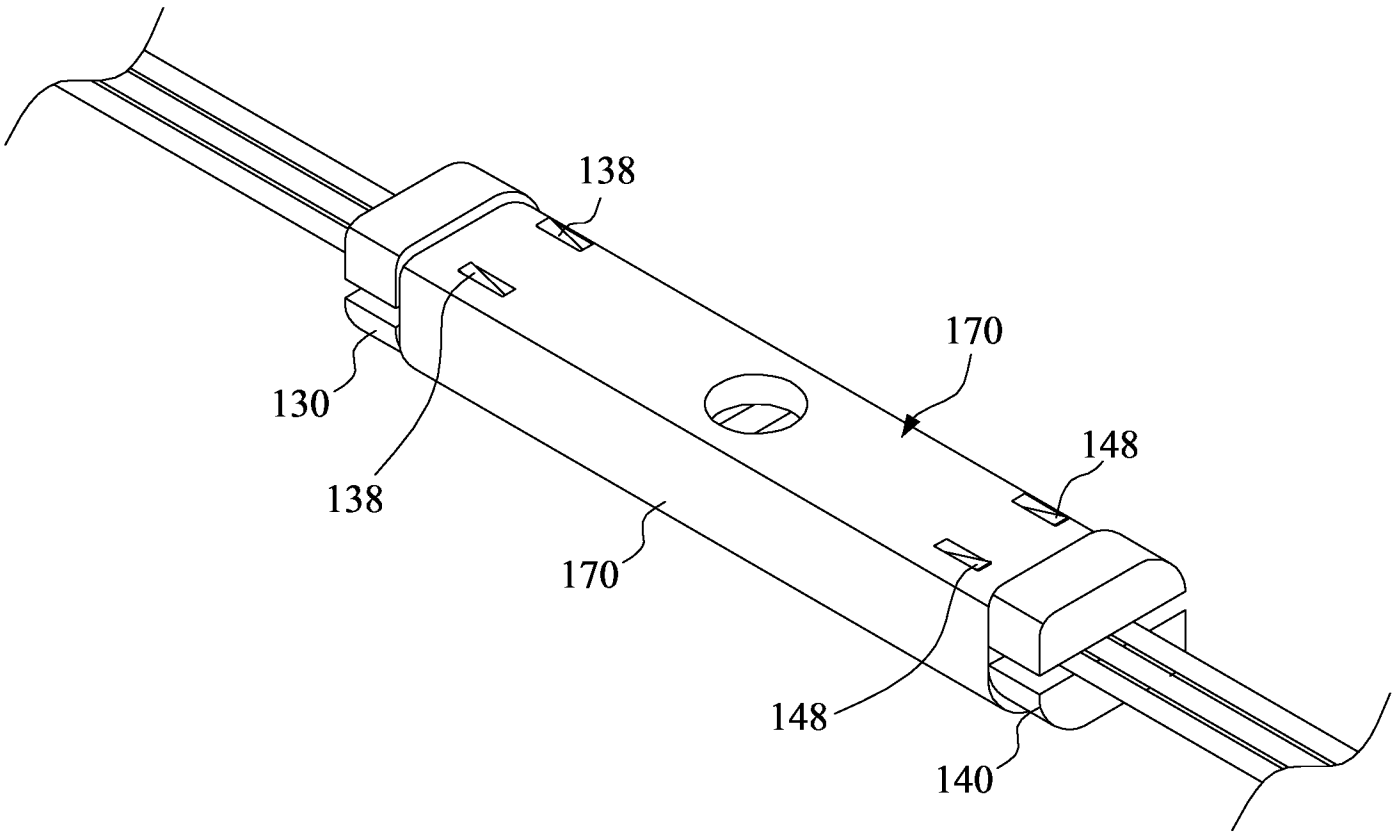
FIG. 11 is a perspective view of the first electrical connector and the second electrical connector connected to each other via another fixing case according to the first embodiment of this disclosure.

As shown in FIG. 11, the first or insertable portion 136 is inserted into the fixing case 170 to have the terminal 132, 142 (wire portion sets 110*a*, 120*a* and 180*a* of connectors 130 and 140) contact the printed wires 172*a*; therefore, the first electrical connector 130 and the second electrical connector 140 are electrically connected by the circuit board 172, and the fixing case 170 covers the first electrical connector 130 and the second electrical connector 140. In this embodiment, the reverse folded portions (serving as the electrical terminals 132, 142) of the first power wire 110, the second power wire 120 and the third power wire 180 are clamped by the fixing case 170, which, in an embodiment, has a tensile strength higher than the tensile strength of soldering.

In an embodiment, conductors 172*a* include first conductor 173, second conductor 175 and third conductor 177. As depicted, second conductor 175 is generally continuous from one end of board 172 to the other, such that a power wire 120 of a first light set 100 is electrically connected to a power wire 120 of a second light set 100 when the connector system is assembled. However, in the depicted embodiment, conductors 173 and 177 are each not continuous. In such an embodiment, wires 110 of two light sets 100 would not be connected, and wires 180 would not be connected due to a discontinuity represented by element 172*b*. In other embodiments, all conductors 173, 175 and 177 are continuous, or any combination of conductors are continuous. As such, various electrical connections may be made between wires of connectors 130 and 140 of first and second light sets 100, respectively.

Furthermore, the first electrical connector 130 and the second electrical connector includes locking structure, which in an embodiment respectively includes at least one latch 138, 148. The joining case 170 includes latch holes 174 corresponding to the latches 138,148. In an embodiment, as depicted, latches 138 and 148 form projections that extend upwardly from a second or bottom surface 179 of a first portion 136 of a connector. When the insertable portions 136 of the first electrical connector 130 and the second electrical connector 140 are respectively inserted into the fixing case 170, the latches 138, 148 are respectively received into one of the latch holes 174, such that the first electrical connector 130 and the second electrical connector 140 are securely fixed to the joining case 170.

As shown in FIG. 10, in addition to the printed wires or conductors 172*a* for electrical bridging, the circuit board 172 may be further equipped with electronic components, such as resistors, transistors, etc., so as to change an electrical connection state between the first electrical connector 130 and the second electrical connector 140.

Figure 12:
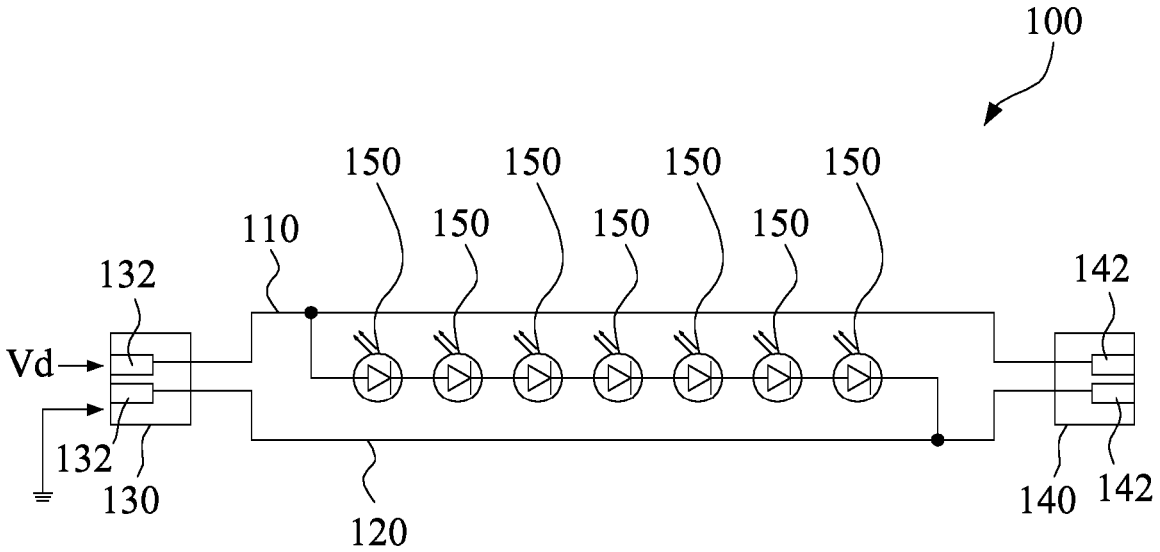
FIG. 12 is a circuit diagram of the serially-connectable light string according to a second embodiment of this disclosure.

Referring to FIG. 12, a serially-connectable light string 100 according to a second embodiment includes a first power wire 110, a second power wire 120, a first electrical connector, a second electrical connector 140, and a plurality of LEDs 150.

In the second embodiment, the plurality of LEDs 150 are connected into a series circuit, and two ends of the series circuit are respectively connected the first power wire 110 and the second power wire 120. By such an approach, the series circuit is electrically grounded via the second power wire 120. In this embodiment, the terminal shorting pin 160 as shown in the first embodiment at FIG. 2 is not required.

Figure 13:
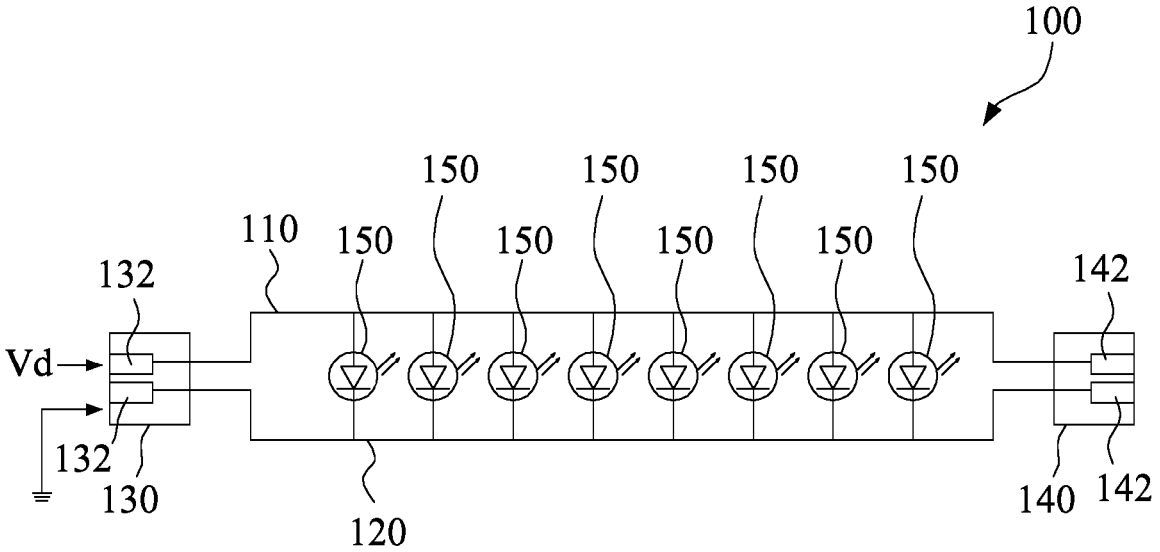
FIG. 13 is a circuit diagram of the serially-connectable light string according to a third embodiment of this disclosure.

Referring to FIG. 13, a serially connectable light string 100 according to a third embodiment includes a first power wire 110, a second power wire 120, a first electrical connector, a second electrical connector 140, and a plurality of LEDs 150.

In the third embodiment, the LEDs 150 are connected in parallel between the first power wire 110 and the second power wire 120. That is, two ends of each LED 150 are respectively connected to the first power wire 110 and the second power wire 120. By such an approach, each LED 150 is electrically grounded via the second power wire 120. In this embodiment, the terminal shorting pin 160 as shown in the first embodiment is also not required.

Figure 14:
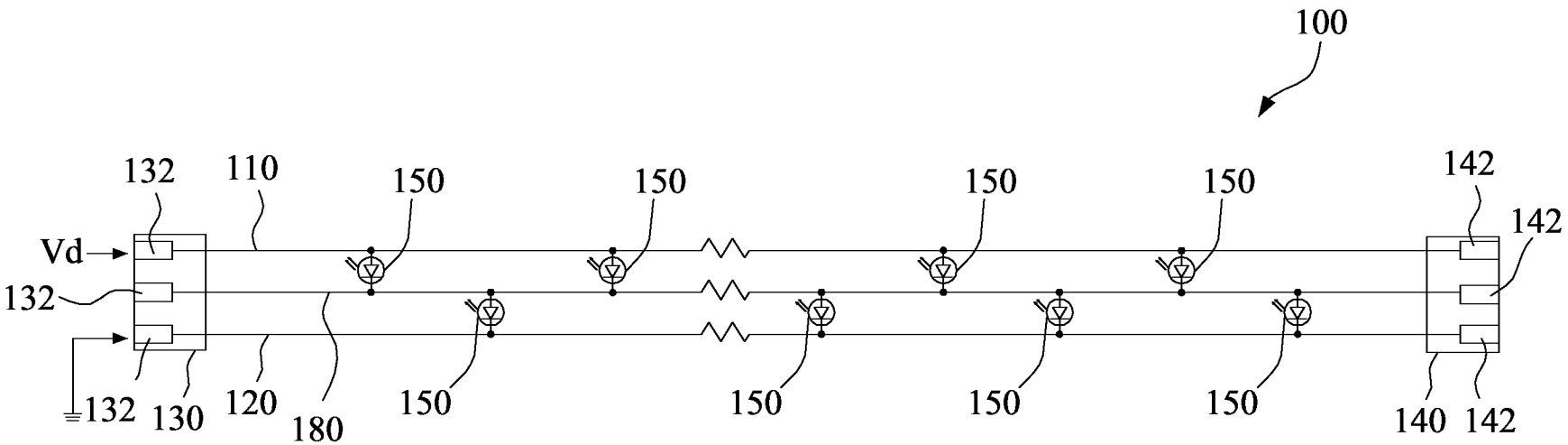
FIG. 14, FIG. 15 and FIG. 16 are circuit diagrams of the serially-connectable light string according to a fourth embodiment of this disclosure.
Figure 15:
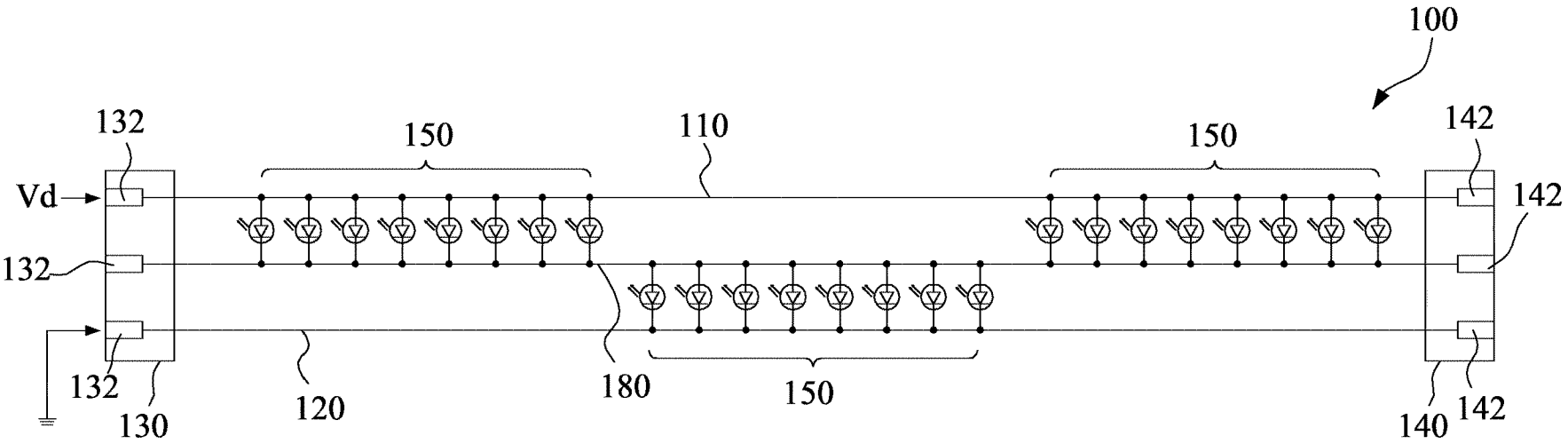
Figure 16:
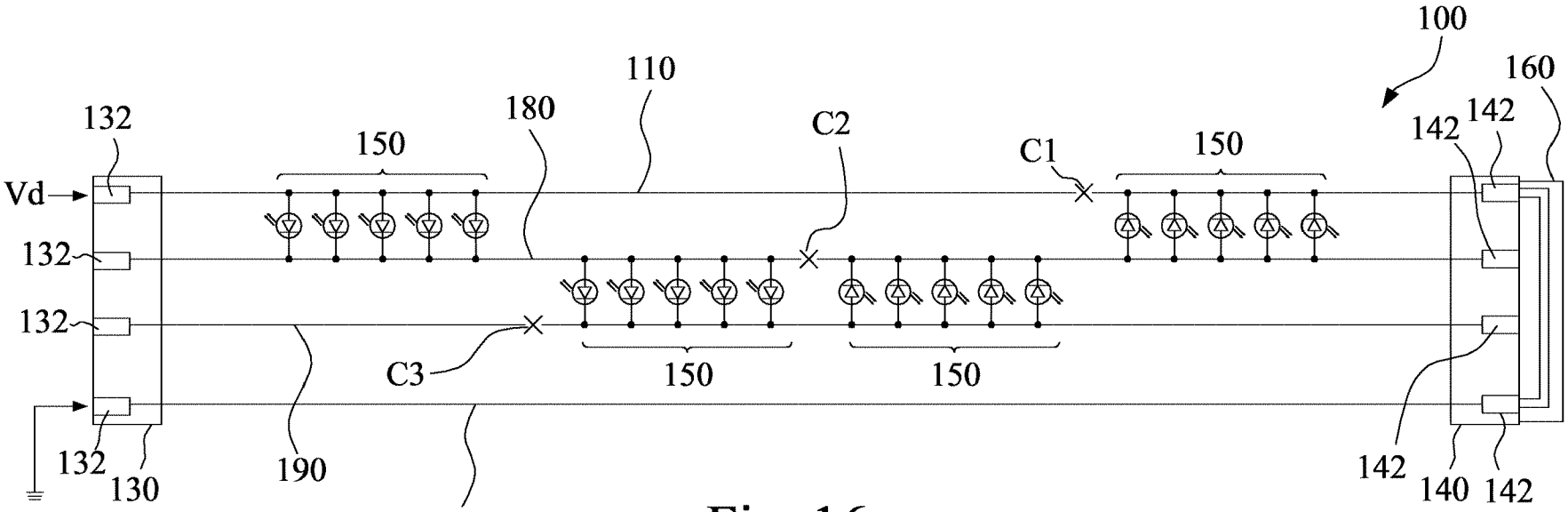

Referring to FIG. 14, FIG. 15 and FIG. 16, a three-wire serially connectable light string 100 according to a fourth embodiment includes a first power wire 110, a second power wire 120, a third power wire 180, a first electrical connector, a second electrical connector 140, and a plurality of LEDs 150.

In the fourth embodiment, the LEDs 150 are connected into a circuit including series circuits and parallel circuits, and two ends of the complex circuit are respectively connected to the first power wire 110 and the second power wire 120. By such an approach, the circuit is electrically grounded via the second power wire 120. In this embodiment, the terminal shorting pin 160 as shown in the first embodiment is not required.

As shown in FIG. 14, the serially connectable light string 100 further includes a third power wire 180. The ends of each LED 150 are respectively connected to the first power wire 110 and the third power wire 180, or the ends of each LED 150 are respectively connected to the third power wire 180 and the second power wire 120; therefore, the third power wire 180 serves as connection node between the LEDs 150, to form the circuit including series circuits and parallel circuits between the first power wire 110 and the second power wire 120. As shown in FIG. 15, the connection of the LEDs 150 is substantially identical to that of FIG. 14, the difference is that the LEDs 150 are arranged alternatively or arranged in groups. In this embodiment the plurality of terminal pins 132,142 of the first electrical connector 130 and the second electrical connector 140 are arranged for two ends of the first power wire 110, the second power wire 120, and the third power wire 180, that is, the first electrical connector 130 and the second electrical connector 140 respectively includes three terminal pins 132, 142.

As shown in FIG. 16, the serially-connectable light string 100 may further include a fourth power wire 190. The serially connectable light string 100 includes a third cut-off point C3, a second cut-off point C2 and a first cut-off point C1 interrupting, or creating a discontinuity in, the fourth power wire 190, the third power wire 180 and the first power wire 110 in sequence, to form the circuit loop in FIG. 16. Each "cut-off point" defines a gap or discontinuity in an otherwise continuous wire. Unlike conventional light strings, a cut-off point wire gap may be very small, such that each wire extends substantially from connector 130 to connector 140, with the exception of a cut-off point gap. In an embodiment, a cut-off point gap is created by cutting the wire without removing a section of the wire; in another embodiment, a cut-off point gap is created by cutting out a small portion of the wire. In either embodiment, the gap created along a wire axis may be less than 1%, or in a range of 1% to 5%, of an overall wire length between connectors 130 and 140. The small range allows for easy manufacturing of the light string using substantially continuous wires.

The terminal shorting pin 160 is inserted to the second electrical connector 140 for short-circuiting the first power wire 110 and the second power wire 120 in the second electrical connector 140. Therefore, two ends of each LED 150 are respectively connected to the first power wire 110 and the third power wire 180, or two ends of each LED 150 are respectively connected to the third power wire 180 and the fourth power wire 190. Therefore, among the cut-off points C1, C2, C3 the LEDs 150 are connected in parallel, and after the cut-off points C1, C2, C3, the parallel circuit is serially connected to another parallel circuit. Meanwhile, the plurality of terminal pins 132,142 of the first electrical connector 130 and the second electrical connector 140 are arranged for two ends of the first power wire 110, the second power wire 120, the third power wire 180 and the fourth power wire 190, that is, the first electrical connector 130 and the second electrical connector 140 respectively includes four terminal pins 132, 142.

Figure 17:
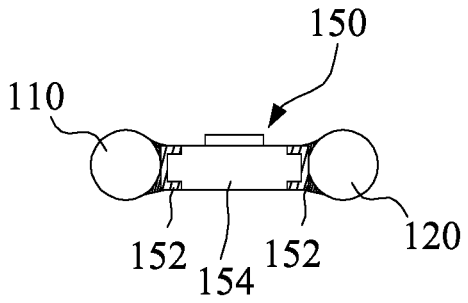
FIG. 17 and FIG. 18 are cross-sectional views showing the soldering structure of the light emitting diode according to one or more embodiments of this disclosure.
Figure 18:
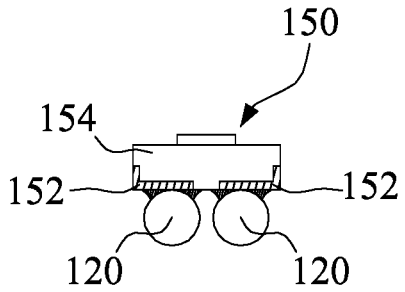

As shown in FIG. 17 and FIG. 18, in the third embodiment, the first power wire 110, the second power wire 120 and the third power wire 180 are single metal wires or stranded conductors combined together by a one-piece insulating layer. Through a wire stripping procedure, the single metal wire or the stranded conductor is partially exposed, so as to allow soldering of the electrodes 152 of the LED 150 onto the power wires. In FIG. 17, the electrodes 152 are disposed on two opposite edges of a substrate 154 of the LED 150, so as to spread two power wires (to spread the first power wire 110 and the second power wire 120, or to spread the second power wire 120 and the third power wire 180, in a direction transverse to a lengthwise, longitudinal axis of the wire) to clamp the LED 150 by the two power wires. In FIG. 18, the electrodes 152 are disposed on the bottom of substrate 154, and the substrate 154 of LEDs 150 is directly soldered onto two power wires (soldered on the first power wire 110 and the second power wire 120, or soldered on the second power wire 120 and the third power wire 180).

Figure 19:
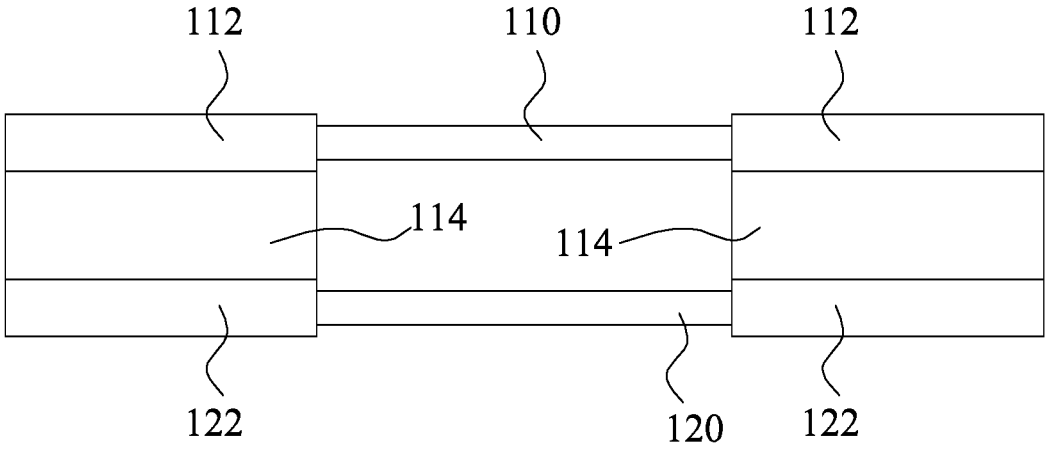
FIG. 19 is a top view of the first power wire and the second power wire according to one or more embodiment of this disclosure.
Figure 20:
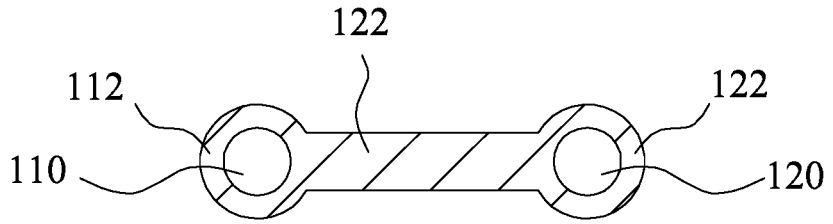
FIG. 20 is a cross-sectional view of the first power wire and the second power wire according to one or more embodiments of this disclosure.

As shown in FIG. 19 and FIG. 20, in the third embodiment, the first power wire 110 and the second power wire 120 are not only wrapped by the insulation layer 112, 122, but also spaced by an extending insulation portion 114, so as to separate the single metal wires or the stranded conductors.

Figure 21:
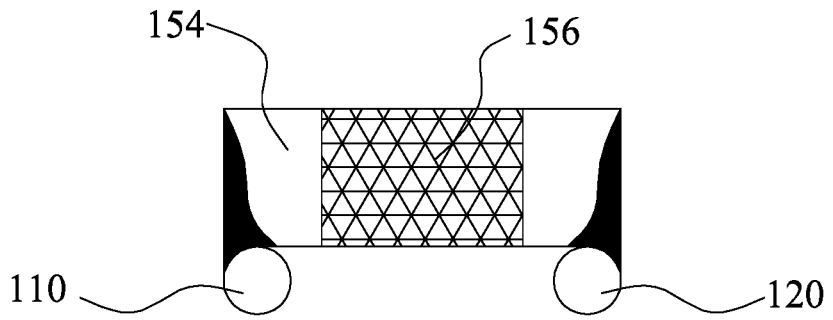
FIG. 21 is a cross-sectional view showing the soldering structure of the light emitting diode according to one or more embodiments of this disclosure.
Figure 22:
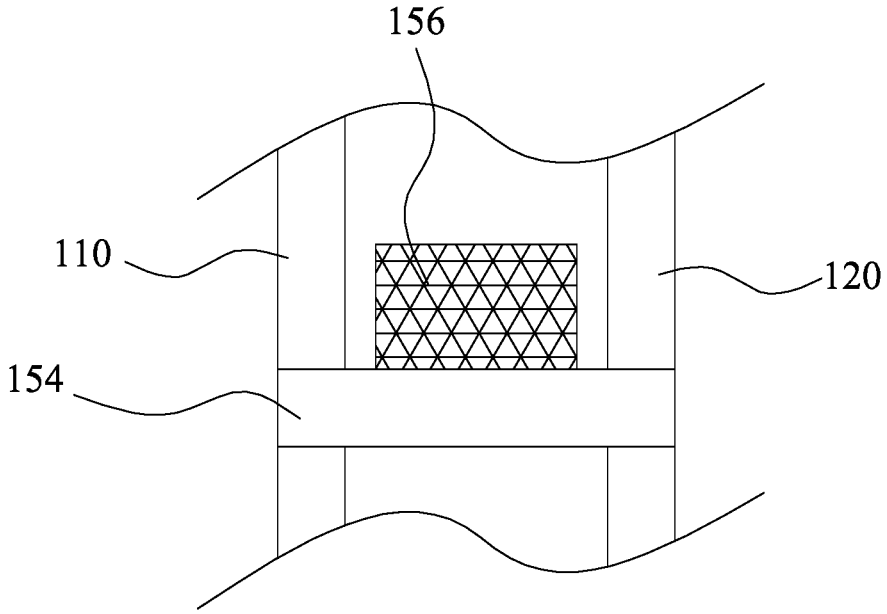
FIG. 22 is a top view showing the soldering structure of the light emitting diode according to one or more embodiments of this disclosure.

As shown in FIG. 21 and FIG. 22, the LED 150 can be a laterally light emitting device. The substrate 154 is directly soldered on the first power wire 110 and the second power wire 120, and the LED chip 154 is located on a lateral side of the substrate 154 to emit light laterally, or along an axis of the wires.

Figure 24:
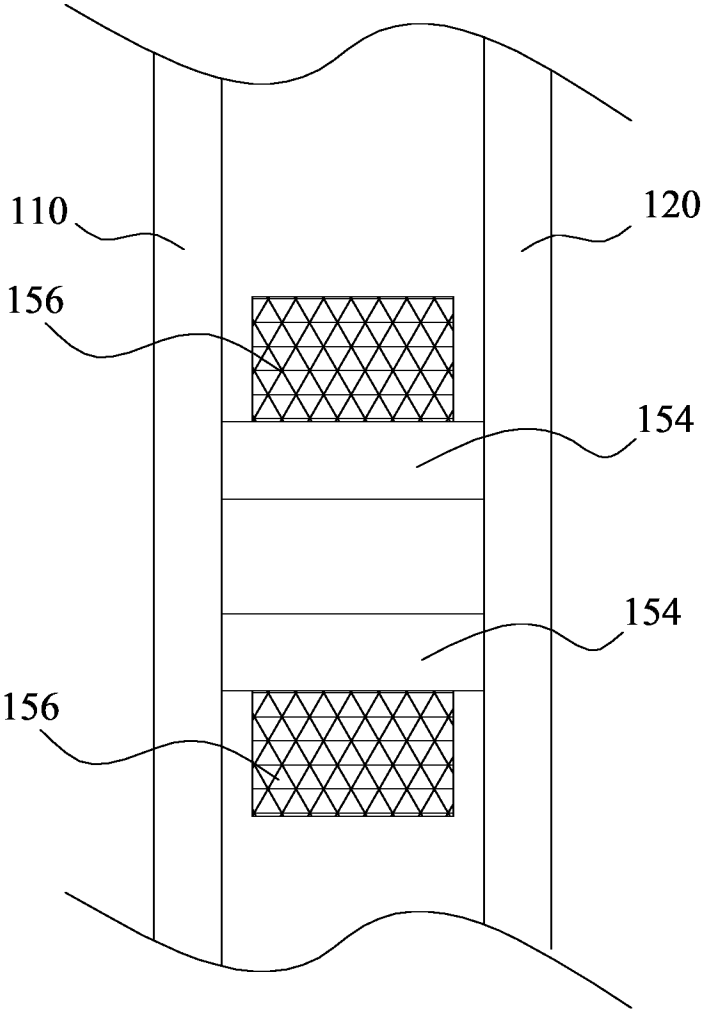
FIG. 24 is a bottom view showing the soldering structure of the light emitting diode according to one or more embodiments of this disclosure.
Figure 23:
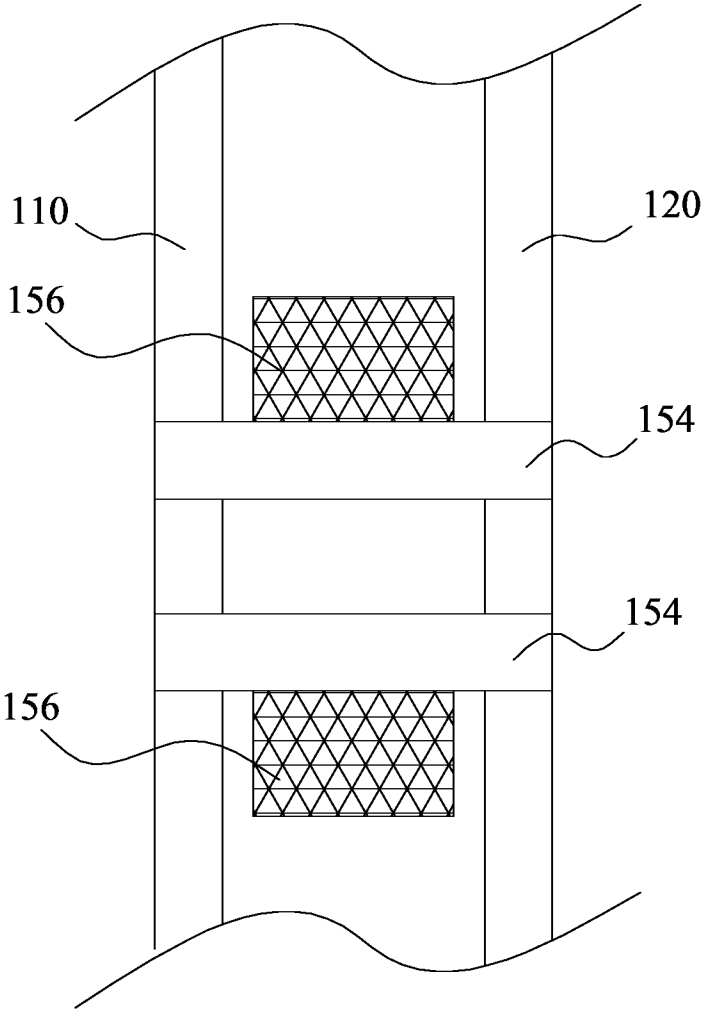
FIG. 23 is a top view showing the soldering structure of the light emitting diode according to one or more embodiments of this disclosure.

As shown in FIG. 23 and FIG. 24, the LEDs 150 can be arranged in pairs, and soldered onto the first power wire 110 and the power wire 120. In each pair, the LED chips 156 are arranged to face opposite directions, so as to emit light in different, opposite directions. As shown in FIG. 19, since the first power wire 110 and the second power wire 120 are separated, the light from the two chips 156 emitted downward will not be blocked by the first power wire 110 and the second power wire 120, that is, by using the arrangement as shown in FIG. 23 and FIG. 24, 360 degree light emitting can be achieved by using two LEDs 150 aimed oppositely and emitting light laterally. As shown in FIG. 22, FIG. 23 and FIG. 24, the LED 150 can be a two faced emitting device.

The substrate 154 is directly soldered on the first power wire 110 and the second power wire 120, two faces of the LED 150 emit light. As shown in FIG. 22, since the first power wire 110 and the second power wire 120 are separated, any light from the two chips 156 emitted downward will not be blocked by the first power wire 110 and the second power wire 120, that is, by using the arrangement as shown in FIG. 22 FIG. 23 and FIG. 24, 360 degree light emitting can be achieved by using one LEDs 150 of a two faced emitting device.

Figure 25:
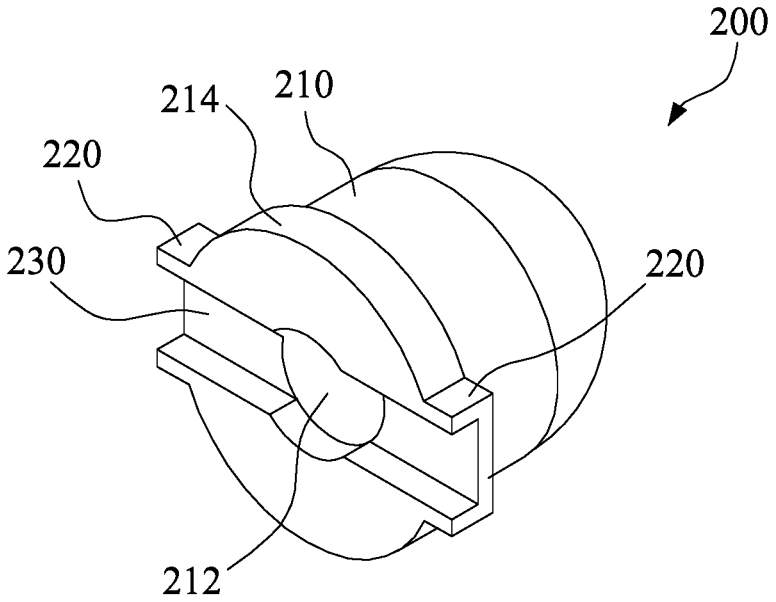
FIG. 25 and FIG. 26 are perspective views of a lamp cap according to one or more embodiments according to this disclosure.
Figure 26:
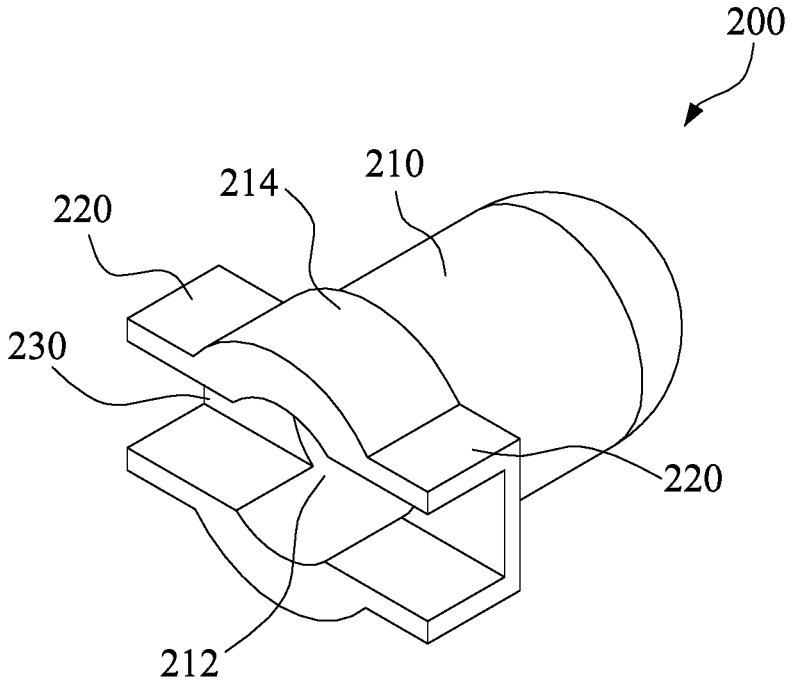

As shown in FIG. 25 and FIG. 26, the serially-connectable light string 100 further includes a plurality of lamp caps 200, made of transparent material.

As shown in FIG. 25 and FIG. 26, each lamp cap 200 includes a body 210 and two guiding portions 220. The upper portion of the body 210 is configured as a condenser lens. A bottom of the body 210 is equipped with an accommodating dent or recess 212 for accommodating the LED 150. The bottom of the body 210 is further equipped with a flange 214 extending outward. The two guiding portions 220 extend outward from an edge of the flange 214, and the two guiding portions 220 extend toward opposite directions. Furthermore, the lamp cap 200 further includes a guiding groove 230, and the guiding groove 230 extends from the bottom of the body 210 to the guiding portions 220 via the flange 212. The guiding groove 230 is provided for accommodating the power wires connected to the LED 150.

According to embodiments of this disclosure, a plurality of serially-connectable light strings 100 can be easily connected in series, so as to elongate the length of a light string 100 as required, and a soldering process is not required.

What is claimed is:

1. A serially-connectable light string, comprising:

a first power wire and a second power wire arranged in parallel;

a first electrical connector connected to one end of the first power wire and to one end of the second power wire;

a second electrical connector connected to another end of the first power wire and another end of the second power wire; wherein, the first electrical connector and the second electrical connector respectively include a plurality of terminal pins corresponding to the first power wire and the second power wire;

a removable shorting device insertable into the second electrical connector; the removable shorting device configured to directly electrically connect the first power wire to the second power wire within the second electrical connector, thereby causing a direct electrical short between the first power wire and the second power wire;

and a plurality of light emitting diodes; connected to the first power wire;

wherein the first power wire is adjacent to the second power wire outside of the first electrical connector and the second electrical connector.

2. The serially-connectable light string as claimed in claim 1, wherein the first electrical connector and the second electrical connector are a cable plug and a cable socket, or the first electrical connector and the second electrical connector are a headphone plug and a headphone socket.

3. The serially-connectable light string as claimed in claim 1, further comprising a joining case, for covering the first electrical connector and a second electrical connector of another serially-connectable light string.

4. The serially-connectable light string as claimed in claim 3, wherein the first electrical connector and the second electrical connector respectively include a plurality of through holes, and the first power wire and the second power wire extend through the through holes and are reverse folded to form the plurality of terminal pins; and the joining case further includes a circuit board, and the circuit board includes printed conductors contacting the plurality terminal pins of the first electrical connector and the second electrical connector.

5. The-serially connectable light string as claimed in claim 1, wherein the plurality of light emitting diodes are connected into a series circuit, and two ends of the series circuit are respectively connected to the first power wire and the second power wire.

6. The serially-connectable light string as claimed in claim 1, wherein the light emitting diodes are connected in parallel between the first power wire and the second power wire.

7. The serially-connectable light string as claimed in claim 1, wherein the plurality of light emitting diodes are arranged into a plurality of parallel circuits and the parallel circuits are connected in series.

8. The serially-connectable light string as claimed in claim 1, further comprising a plurality of transparent lamp caps; wherein each of the lamp caps includes a body, two guiding portions and a guiding groove, a bottom of the body is equipped with an accommodating dent and a flange extending outward, the two guiding portions extend outward from an edge of the flange, and the guiding groove extends from the bottom of the body to the guiding portion via the flange.

9. The serially-connectable light string as claimed in claim 1, wherein the first power wire and the second power wire are wrapped by an insulation layer and spaced from each other by an extending insulation portion of the insulation layer.

10. The serially-connectable light string as claimed in claim 1, wherein the removable shorting device is a removable shorting plug configured to be removed by a user.

11. A serially-connectable light string, comprising:

a first power wire and a second power wire arranged in parallel;

a first electrical connector connected to one end of the first power wire and to one end of the second power wire;

a second electrical connector connected to another end of the first power wire and another end of the second power wire; wherein, the first electrical connector and the second electrical connector respectively include a first terminal pin and a second terminal pin corresponding to the first power wire and the second power wire, respectively; and a plurality of light emitting diodes, connected to the first power wire;

wherein the first electrical connector and the second electrical connector respectively include a plurality of through holes, and the first power wire and the second power wire extend continuously through the through holes and are reverse folded to form the first and second terminal pins, the first terminal pin being continuous and to a conductor of the first power wire, and the second terminal being continuous with a conductor of the second power wire.

12. The serially-connectable light string as claimed in claim 11, further comprising a terminal shorting pin, inserted into the second electrical connector for short-circuiting the first power wire and the second power wire in the second electrical connector.

13. The serially-connectable light string as claimed in claim 11, further comprising a shorting device removably insertable into the second electrical connector, the shorting device configured to directly electrically connect the first power wire to the second power wire within the second electrical connector, thereby causing a direct electrical short between the first power wire and the second power wire.

14. The serially-connectable light string as claimed in claim 11, further comprising a joining case, for covering the first electrical connector and a second electrical connector of another serially-connectable light string.

15. The serially-connectable light string as claimed in claim 14, wherein the joining case further includes a circuit board, and the circuit board includes printed conductors contacting the plurality terminal pins of the first electrical connector and the second electrical connector.

16. The-serially connectable light string as claimed in claim 11, wherein the plurality of light emitting diodes are connected into a series circuit, and two ends of the series circuit are respectively connected to the first power wire and the second power wire.

17. The serially-connectable light string as claimed in claim 11, wherein the light emitting diodes are connected in parallel between the first power wire and the second power wire.

18. The serially-connectable light string as claimed in claim 11, wherein the plurality of light emitting diodes are arranged into a plurality of parallel circuits and the parallel circuits are connected in series.

19. The serially-connectable light string as claimed in claim 11, further comprising a plurality of transparent lamp caps; wherein each of the lamp caps includes a body, two guiding portions and a guiding groove, a bottom of the body is equipped with an accommodating dent and a flange extending outward, the two guiding portions extend outward from an edge of the flange, and the guiding groove extends from the bottom of the body to the guiding portion via the flange.

20. The serially-connectable light string as claimed in claim 11, wherein the first power wire and the second power wire are wrapped by an insulation layer and spaced from each other by an extending insulation portion of the insulation layer.

* * * * *